United States Patent [19]

Cole

[11] Patent Number: 4,626,176

[45] Date of Patent: Dec. 2, 1986

[54] PUMP EMPLOYING THE SUCTION EFFECT OF A ROTATING LIQUID RING

[75] Inventor: Michael Cole, Ipswich, England

[73] Assignee: Genevac Limited, England

[21] Appl. No.: 727,541

[22] Filed: Apr. 26, 1985

[30] Foreign Application Priority Data

| | | | |
|---|---|---|---|
| May 3, 1984 | [GB] | United Kingdom | 8411364 |
| Sep. 12, 1984 | [GB] | United Kingdom | 8422995 |
| Dec. 6, 1984 | [GB] | United Kingdom | 8430889 |

[51] Int. Cl.[4] ..... F04C 19/00

[52] U.S. Cl. ..... 417/54; 417/68; 417/76

[58] Field of Search ..... 417/54, 65–69, 417/76, 77, 85, 87, 151, 158, 198

[56] References Cited

U.S. PATENT DOCUMENTS

| | | | |
|---|---|---|---|
| 928,775 | 7/1909 | Mathis | 417/76 X |
| 1,699,327 | 1/1929 | Durdin, Jr. | 417/67 |
| 1,864,640 | 6/1932 | Dalrymple | 417/68 |
| 2,091,642 | 8/1937 | Lingenbrink | 417/196 |
| 2,260,600 | 10/1941 | Boeckeler | 417/77 |
| 2,295,024 | 9/1942 | Boeckeler | 417/77 |
| 3,030,005 | 4/1962 | Le Nabour et al. | 417/198 X |
| 4,074,954 | 2/1978 | Roberts | 417/68 |

*Primary Examiner*—William L. Freeh
*Assistant Examiner*—Paul F. Neils
*Attorney, Agent, or Firm*—Louis Weinstein

[57] ABSTRACT

A fluid pump having an outer cylindrical housing (10) rotating relative to an inner hub (44) from which radially projects a probe (52) apertured in its external surface to be exposed to the flow therepast of an annulus of operational liquid (14) constrained in a circular path of motion by the rotating housing, the probe having an internal passage for communicating the aperture with a first external space and the inner liquid-free space in the housing having an outlet for communicating with a second external space. In use, fluid to be pumped is sucked out of the apertured probe to emerge as fluid bubbles which migrate through the rotating liquid annulus to the liquid-free center, then to pass to the outlet.

22 Claims, 6 Drawing Figures

PUMP EMPLOYING THE SUCTION EFFECT OF A ROTATING LIQUID RING

FIELD OF INVENTION

This invention relates to a pump in which suction is achieved by interaction between a working liquid and an orifice. Such pumps may be used for either evacuating fluids from or compressing fluids into closed spaces.

The term fluid as used herein means a fluid which is less dense than the working liquid utilised in the pump, and may be a gas or gaseous mixture such as air.

In pumps of this type, where the fluid is a gas, a degree of mixing (as by dissolving or limited entrainment of gas bubbles) may be acceptable. However where liquids are concerned they should not in general be totally miscible.

BACKGROUND TO THE INVENTION AND PRIOR ART

U.S. Pat. No. 3,384,023 describes an example of such a pump in which a liquid annulus is created by rotating a housing (26) within which is mounted a stationary disc (32) carrying four velocity tubes (50), each of which includes a venturi restriction (56). In each velocity tube there is an enlarged cavity (64) to the rear of the venturi restriction (56) and the cavity communicates with a passage (54). As the working liquid is rotated past each velocity tube (50) some of the liquid passes into the tube and on passing axially through the venturi restriction reduces the pressure within the cavity (64) behind the restriction due to volume changes within the tube. This causes fluid to be drawn through the the passage (54) and into the velocity tube for discharge through the end (62).

Other velocity tube devices are indicated as being usable, operating on an aspirator or jet pump principle, in place of the described nozzle-venturi combination.

Examples given are:

(1) a simple venturi tube with the suction tube (54) connected to the throat of the venturi restriction, and;

(2) a tube incorporating an internal pitot tube connected to the suction tube (54).

However, all the described pumps employ suction producing devices in which the suction producing orifice is located in an internal surface of the device and suction is only achieved by causing the working liquid to pass through the device. Since the suction effect is related to flow rate and volume, the pumping speed (i.e. throughput) is severely limited due to the small flows which such velocity tube devices can accommodate.

The present invention on the other hand is concerned with a pump which whilst utilizing the interaction between a working liquid and an orifice to provide a suction effect on a fluid, does not require the working liquid to flow through an orifice to obtain the suction effect. The pump of the present invention does not therefore suffer the same pumping speed restrictions as the prior art designs do and is thereby capable of greatly increased performance and throughput.

SUMMARY OF INVENTION

According to the present invention, there is provided a pump comprising:

a pump housing having a generally cylindrical interior and enclosing a quantity of working liquid, at least one probe having at least one aperture on its exterior surface and internal passage means for communicating said aperture with a first external space, means for causing the working liquid to move in a circular path inside the housing and relative to and past the aperture in the probe, and outlet means for communicating between a second external space and a central region of the housing which in use is free of working liquid, whereby fluid to be pumped is drawn from the said first external space, through the aperture in the exterior surface of the probe, to pass as fluid bubbles towards the central region of the housing as a result of centrifugal forces acting on the more dense working liquid, the bubbles migrating through the circulating liquid into the central region to pass out of the housing through the outlet means. The aperture in the external surface of the probe can (assuming the probe to be of sufficient width) be extended so as to co-act with liquid across substantially the whole of the width of the pump housing, thereby increasing the pumping speed.

The term 'generally cylindrical' is used in this specification to include housing interiors which depart to some degree from perfect cylindricality, and which may for example be slightly ellipsoidal or oval or which have irregularities in their internal walls and is intended also to include a tapering cylinder.

The pump will generally comprise relatively rotating inner and outer parts, one carrying the probe or probes and the other causing the working liquid to move in its circular path.

In one embodiment, the pump housing forms the stator of the pump and carries the probe or probes, whilst the rotor is formed by the circulating liquid. Because the rotor is a mass of liquid, it automatically forms the necessary seal between the rotor and the stator, and additionally no lubrication is required as would be required between a solid rotor and a solid stator.

In one embodiment the means for causing the liquid to move in a circular path is an impeller (constituting the inner part of the pump) mounted coaxially ithin the housing and having radially-extending blades which extend into the liquid flow path. The blades do not need to, and should not, extend into contact with the pump housing.

In an alternative embodiment, the pump housing rotates about a central hub constituting the inner part of the pump, and the rotation of the housing produces the desired circular movement of the liquid. The probe or probes can then be mounted on the central hub so that it or they project radially from the hub into the flow path.

According to an important feature of the invention, the part of the pump not carrying the probe or probes, preferably the housing, carries angularly spaced protrusions.

It is believed that it is necessary for the said protrusions to pass sufficiently close to the probe or probes to cause short bursts of acceleration of the region of liquid local to each probe, as the liquid is squeezed between the probe and the protrusion passing thereby, in order to enhance suction at the probe aperture.

Most preferably, the spacing apart and the individual shapes of the protrusions and their spacing from each probe is optimised to maximise the flow of fluid drawn through the probe as a result of the acceleration of the liquid past the aperture(s) for a given power input for driving the relatively rotating parts of the pump.

Each probe can be in the form of a tube having a closed end with the aperture in a side wall of the tube.

The tube may be circular in cross-section or may have a triangular cross-sectional shape or may be of a more flattened streamlined cross-sectional shape, although it is anticipated that other probe shapes could alternatively be used, including shapes chosen to minimise the hydrodynamic drag exerted on the liquid rotor by the probe.

In a particularly preferred design the probe is in the form of a wing extending parallel to the pump axis, and supported on a strut attached to the hub.

Alternatively, in a preferred embodiment, the or each probe such as a wing is supported by a disc located within the pump housing, the latter constituting the rotating part of the pump.

Preferably, the faces of the stationary supporting disc are narrowly spaced from respective rotating plate surfaces wherein thin liquid films are contained. Thus, in one instance, one face of the supporting disc is spaced from one end face of the housing by one said liquid film and the other face of the disc is spaced by another said liquid film from a guard disc mounted to rotate with the housing. The mounting of the guard disc is apertured to provide for passage of fluid to the central region of the housing.

However, a centrally located supporting disc with a guard disc on each side thereof is also possible.

Both the inlet to and the outlet from the pump may pass through the hub.

Where a circular cross section tubular probe extends radially within the housing it is found that the aperture should face in a direction substantially perpendicular to the general direction of flow relative to the probe (i.e., the aperture axis should be substantially perpendicular to the direction of flow).

If such a circular cross section probe extends axially parallel to the axis of the cylindrical interior of the housing at a position remote from the said axis, the aperture is again advantageously oriented so as to face in a direction substantially perpendicular to the general direction of liquid flow relative to the probe. This may be either so as to face radially inwardly or radially outwardly.

By "substantially perpendicular" is meant that the aperture axis subtends an angle to the general direction of liquid flow in the range 45° to 120°, typically 50° to 90°. These ranges are based on empirical observations and it is possible that wider or different ranges may be appropriate depending on further experimental work.

Positioning the aperture so that its axis is substantially perpendicular to the direction of flow produces a substantial suction effect through the probe, which enables the pump to function. Fluid such as air or gas, sucked in through the probe, passes towards the central region of the housing as a result of centrifugal forces acting on the more dense liquid, and thereby migrates through the liquid flow into the cylindrical space of the housing, from where it can escape.

If a probe has a wing cross-section, the aperture is preferably located in a part of the wing surface at which a region of low pressure is created during fluid flow. As with the cylindrical tubular probe, the wing may be located in the housing so that the cross-section of the wing extends generally radially or generally parallel to the axis of the cylindrical housing.

One preferred wing profile has a shape affording a ramp surface at the leading edge of the wing, preceding the aperture. The ramp may be linear or convexly or concavely curved. The aperture is preferably disposed at the top of the ramp. The downstream wing surface may also be in the form of a ramp which may be linear but more probably is convexly curved so as to maximise the suction effect whilst minimising drag.

Where appropriate, valve means such as for example a one way valve, may be provided in the fluid path to the probe aperture and other such valve means may be provided in the outlet means from the housing.

The liquid used can be chosen according to the particular application and may include water or oil or liquid metals although this list is not intended to be exhaustive.

When used as a vacuum pump, where a high vacuum is required and clean gases are being pumped, a vacuum oil or fluid would typically be used. A low melting point liquid metal or metal alloy such as an indium gallium tin eutectic may be employed when total absence of hydrocarbons is required.

Where the liquid becomes contaminated in use, means may be provided for replacing the liquid or filtering same.

Water can be used as the working liquid for compressing gases such as air and for evacuating if only a moderate vacuum is required.

Where a fluid to be pumped is chemically aggressive and the pump requires any sealing liquids also to have lubricating properties, it is often difficult and usually expensive to find an appropriate chemically inert substance. However, a pump constructed in accordance with the present invention requires no lubrication as such in the pumping chamber. There is therefore no requirement for the working liquid to have lubricating properties in the working area of the pump, and therefore there is a greater choice of liquids available.

If a magnetic or magnetisable or electrically conductive liquid is employed such as for example a liquid metal or liquid metal alloy, the rotation of this liquid relative to the probe or probes may be effected by influencing the liquid with a rotating magnetic field, in which event the housing may remain stationary or be rotated. The material forming the housing must not impede or screen the magnetic field if this is established by external means such as a coil.

It has also been found that where a wing with a leading edge ramp profile is employed, the pumping speed (i.e., throughput) can be increased by providing one or more disturbance bars in the form or ridges or protrusions on the surface of the ramp, so as to introduce a rough surface effect on the ramp. It is believed that this increases the turbulance in the region of the aperture and this increases the suction effect.

BRIEF DESCRIPTION OF THE DRAWINGS

The invention will now be further described, by way of example, with reference to the accompanying drawings in which.

DESCRIPTION OF EMBODIMENTS

Figure 1:
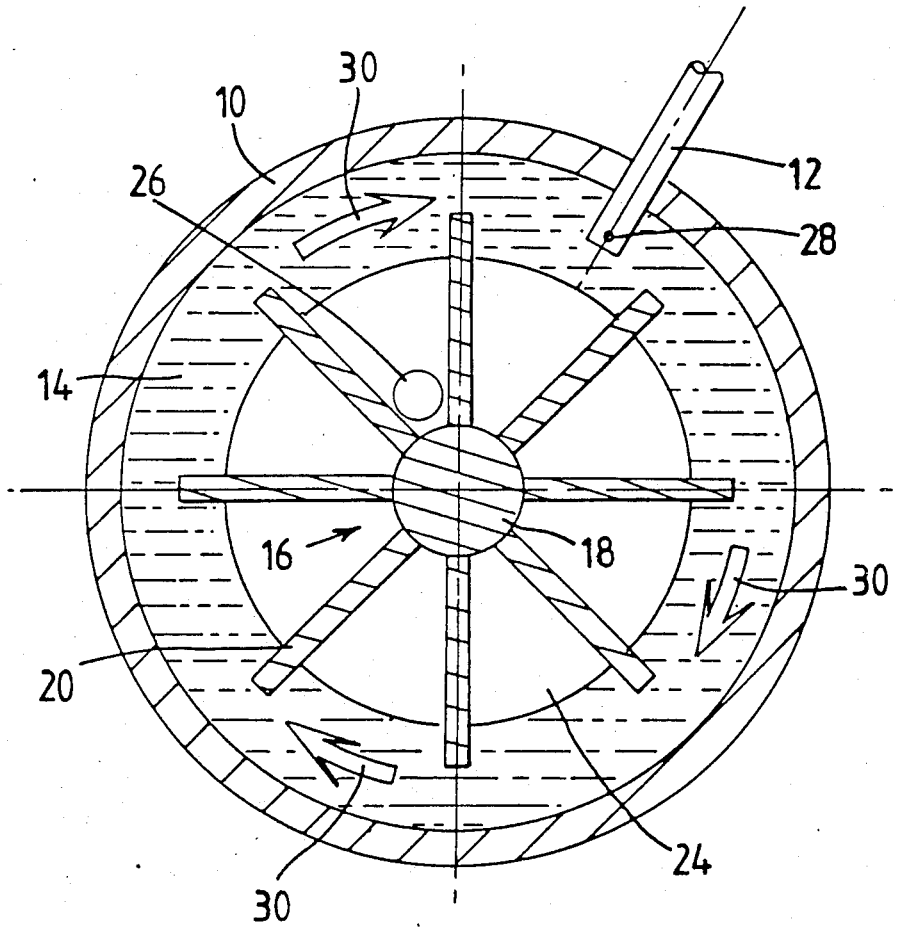
FIG. 1 is a transverse cross-section through a pump constructed as a first embodiment of the invention.

The pumps shown in the drawings can be used either to evacuate or partially evacuate an enclosure connected to the input so as to produce a vacuum, or can be used to compress fluid, especially air or gas, into a chamber connected to the output. As shown the pumps are intended to operate as vacuum pumps.

The pump shown in FIG. 1 has a cylindrical housing 10, and a tubular probe 12 extending through the housing wall.

Within the housing is a body of liquid 14. In the Figure, this body of liquid is shown in the position which it will take up when the pump is in use, i.e., when the body of liquid has a high circular speed of rotation causing the liquid to be forced out against the housing walls.

Figure 2:
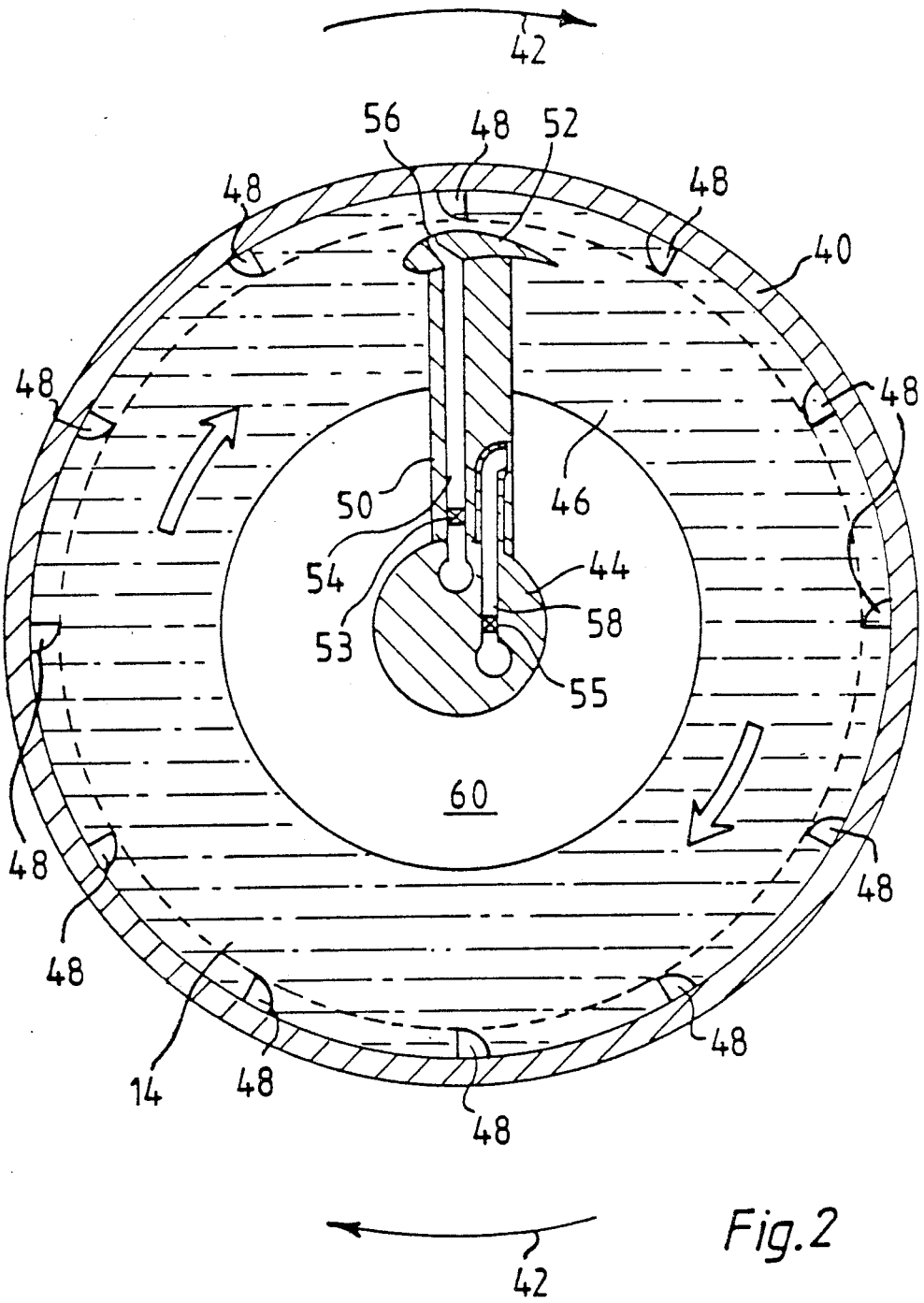
FIG. 2 is a cross-section through a pump constructed as a second embodiment of the invention.

Mounted coaxially within the housing is an impeller 16 which has a central core 18 and a number or radial blades 20. An external motor (such as shown in part in FIG. 4) will drive the impeller 16 in rotation and the rotating blades 20 will act on the liquid 14 to set this in motion. Thus the rotating impeller 16 will cause the liquid to move in its circular path, and this will result in a cylindrical space 24 at the centre of the housing being free of liquid during operation. Since the pump is intended to operate as a vacuum pump outlet 26 extends from the space 24 to atmosphere, and when the pressure in the space 24 builds up above atmospheric, the excess pressure is dissipated through the outlet 26. Where a flow control valve such as a one-way valve is to be incorporated in the inlet or the outlet or both it may be located at equivalent positions such as are shown in FIG. 2.

In the case of a multistage pump, the outlet 26 will be connected to the inlet of the next stage of the pump.

The probe 12 shown is in the form of a cylindrical tube and this tube will be connected to the space to be evacuated. Near the bottom of the tube is an opening in the tube side wall. The end of the tube is closed. As shown, this opening 28 is open in a direction generally perpendicular to the flow of liquid indicated by the arrows 30. As the body of liquid 14 rotates, air or gas is drawn through the tubular probe 12 through the opening 28 and into the body of liquid. From there, the fluid (such as air or gas) which is now in the form of bubbles, migrates into the central space 24 and escapes through the outlet 26.

More than one tubular probe 12 may be located around the cylindrical housing to provide separate independent pumping devices or if connected in parallel to increase the pumping speed or throughput.

Figure 4:
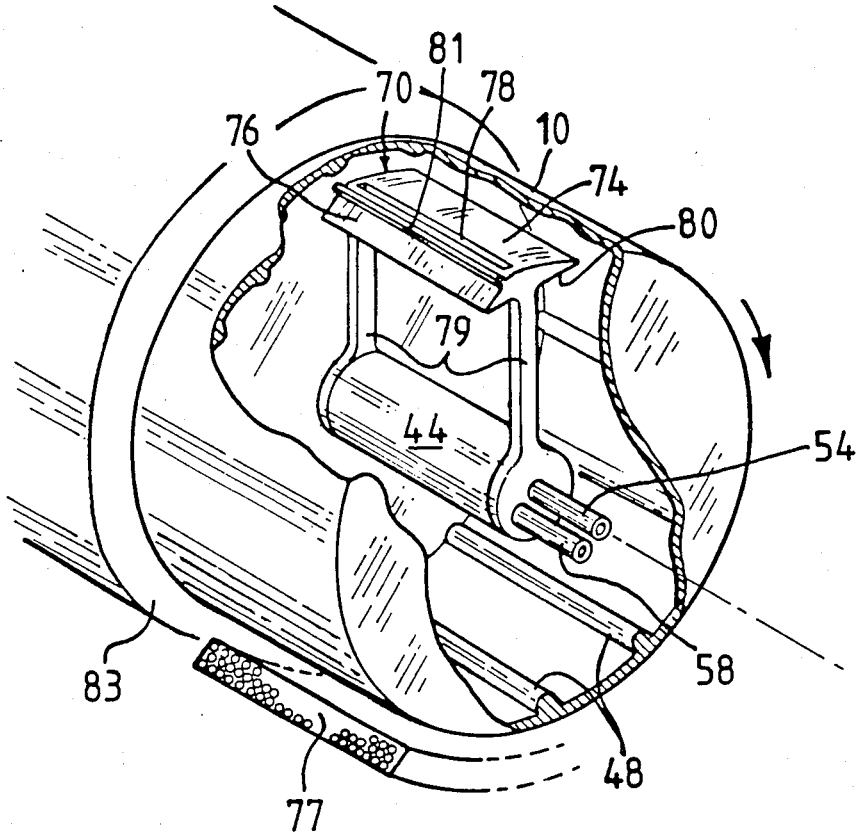
FIG. 4 is a cut-away view showing the second embodiment with a minor modification.

The pump shown in FIG. 2 also has a housing 10 which is set in rotation in the direction of arrows 42 by an external motor (not shown in the Figure but which would be similar to that shown in part in FIG. 4). The housing rotates about a central hub 44. As in the embodiment of FIG. 1, a body of liquid 46 is shown in the position it will take up when in use.

Radial protrusions 48 are provided around the inner surface of the housing 10. These protrusions help to set the liquid 46 in motion when the housing rotates, but also serve another important purpose, as later described.

The protrusions 48 may extend parallel to the axis of the housing or may be skewed relative thereto.

A stem 50 (preferably streamlined in shape) extends radially from the hub 44 and carries a probe 52 which is located within the flowing liquid 46. The probe is wing shaped and is aligned with the liquid flow direction and extends nearly the full length of the cylinder. A suction passage 54 opens in the radially outer surface of the probe and may be a circular hole 56 (or holes) or preferably a slot parallel to the pump axis.

An exhaust passage 58 opens into the cylindrical space 60 at the centre of the pump, and both passages 54 and 58 pass out of the pump through the central hub 44.

When employed to compress air (or a gas), the chamber into which the air or gas is to be pumped is connected to the exhaust passage 26 in FIG. 1 (58 in FIG. 2) and the inlet 12 in FIG. 1 (54 in FIG. 2) is left to communicate with atmosphere (in the case of a straightforward air compression) or to the source of gas (where the pump is being employed to compress a specific gas). References 53 and 55 denote the possible positions for flow control valves such as one way valves, if either or both is required, in the FIG. 2 embodiment.

The liquid 14 may, in use of the pump for evacuation or for compression purposes, be oil or possibly water or, if hydrocarbon absence is essential, a low melting point liquid metal or alloy.

As with the FIG. 1 embodiment, more than one probe and stem assembly such as 50, 52 may be mounted to extend radially from the hub 44, so as to be circularly spaced around the housing.

Figure 3:
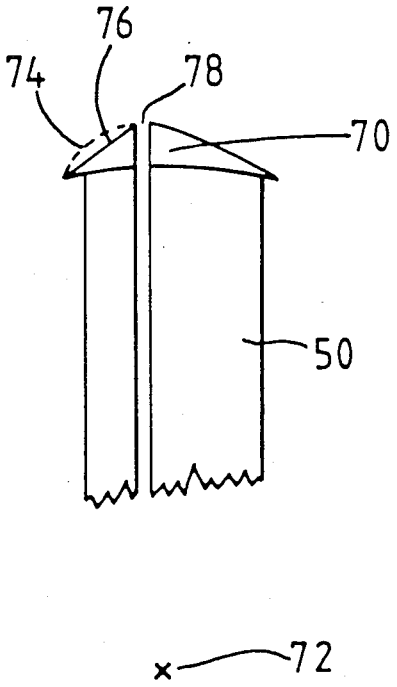
FIG. 3 shows a modification to the second embodiment.

FIG. 3 shows a modification of the probe 52 of FIG. 2. In this modification, the probe 70 carried by stem 50 has a basic wing shape based on an axis which is curved.

The basic wing shape 74 is, however, cut away to form a linear ramp 76 on the leading side of the wing. The aperture 78, corresponding to the aperture 56 of FIG. 2, lies at the top of this linear ramp 76. The ramp may alternatively be convexly or concavely curved.

Filters and/or valve means may be employed in the inlet and outlet as required, as exemplified by the previously referred to valves 53 and 55.

In another and possibly preferred modification (see FIG. 4), the underside of the wing 70 is a planar surface, which at least in some circumstances can reduce drag.

FIG. 4 shows the pump of FIG. 2 in a cut-away view, with the modification that the radial protrusions 48 on the interior of the housing 10 are in the form of hemicylindrical ribs. The wing 70 can be seen to be supported from the hub 44 on two radial struts 79. This wing has a linear ramp surface 76 with an elongate aperture 78 at the top thereof, and downstream of the ramp has a convexly curved surface 74. The undersurface 80 of the wing is planar.

Further refinements shown in FIG. 4 comprise the inclusion of a disturbance bar or ridge 81 across the width of the surface of the ramp 76. More than one such ridge may be included. Also shown at 77 is part of a winding through which electric current can be passed to produce a rotating magnetic field for circulating the liquid if the latter is magnetic or conductive. Also shown at 83 is an electric motor housing for driving the housing 10. The magnetic and electric motor drives may be used exclusively or may be used in conjunction.

Although the struts 79 are shown as having blunt square leading edges, these would be practice be tapered or streamlined to reduce drag.

A most important feature of the pump concerns the spacing of the radial protrusions 48 from the wing-shaped probe 70, and in particular from the approximately radially directed elongate aperture 78 thereof at the top of the linear ramp 76.

This spacing is sufficiently small to produce a squeezing of the local region of the working liquid 14 in use, as each protrusion 48 passes the probe 70. The resulting burst of acceleration of the liquid, in said local region, enhances the suction effect at the aperture 78, especially in the presence of the ramp surface 74.

It is especially important to note that increasing the speed of rotation of the pump will increase the pumping rate, but increased power input is required to a disproportionate, unfavourable extent. However, the local bursts of acceleration give a substantial increase in pumping rate, due to the pulsating suction effect at the probe aperture 78, without requiring such a disproportionate increase in power input. For a given power input, the pumping rate is readily optimised by appropriate selection of the number of angularly spaced radial protrusions 48 and their spacing from the probe or probes 70.

The suction effect is believed to be due, at least in part, to turbulance of the liquid which is created in the region of the aperture caused by separation of the liquid from the probe surface at the top of the ramp.

Figure 5:
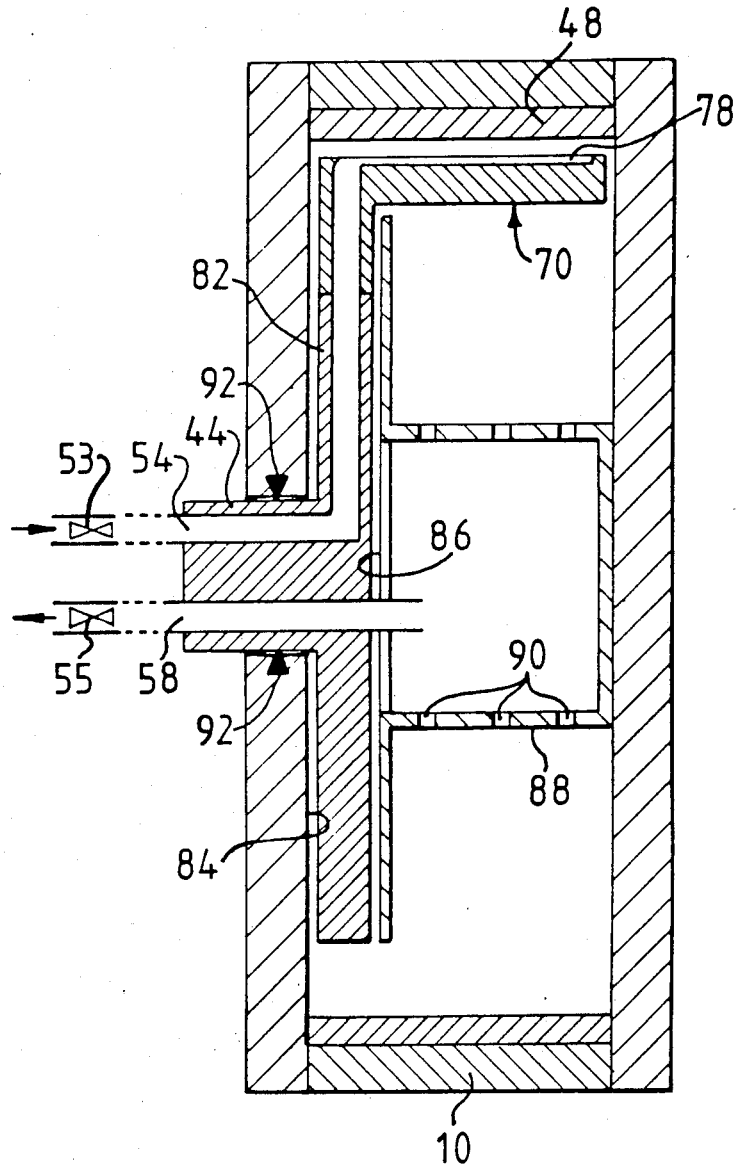
FIG. 5 shows a preferred embodiment in axial cross-section.

A preferred pump utilising the last described effect is shown in FIG. 5, wherein the same references are employed for parts similar to the embodiment of FIGS. 2, 3 and 4.

In order to reduce drag effects caused by the stem 50 or radial struts 79, the wing-shaped probe 70 is carried by a supporting disc 82. With such an arrangement, resistive drag effects can be reduced by positioning the disc 82 adjacent one axial end face 84 of the housing 10, and providing a guard disc 86 carried by the housing adjacent the opposite side of the supporting disc. The plate like surfaces 84 and 86 define narrow spacings against each face of the supporting disc, within which, at least in the region of the outer periphery of the disc within the operational liquid annulus, a thin film of liquid is contained. In theory the thickness of each such liquid film should be just sufficient to contain two boundary layers of the liquid, which, when the housing is rotating relative to the supporting disc, are able to move past one another with a minimum shearing effect. Although a residual resistive drag effect remains, the total resistance is reduced. This is because the major part of the drag resistance is created by turbulance in the adjacent liquid created by the relative circular motion. In a restricted space adjacent the supporting disc, an insufficient thickness of liquid is contained to permit turbulant paths of motion to be created and thus a major part of the normally experienced drag resistance can be avoided.

In practice it is difficult to achieve the theoretical ideal mentioned above since the boundary layer thicknesses will vary with radius and temperature for any given fluid and speed of rotation. In practice it has been found sufficient to reduce the gap between the annular sufaces when using conventional vacuum oil to approximately 1 mm and similar considerations would appear to apply when other working liquids are used.

As exemplified by FIG. 5, the guard disc 86 is mounted to the housing 10 by a mounting tube 88 apertured at 90 to enable air, gas or other fluid to be pumped to pass into the central region of the pump. FIG. 5 also shows the rotating housing 10 sealing to the hub 44 by means of a triangular section seal 92, thereby to reduce friction, and the inlet passage 54 to the probe and the outlet passage 58 from the pump passing through said hub.

Figure 6:
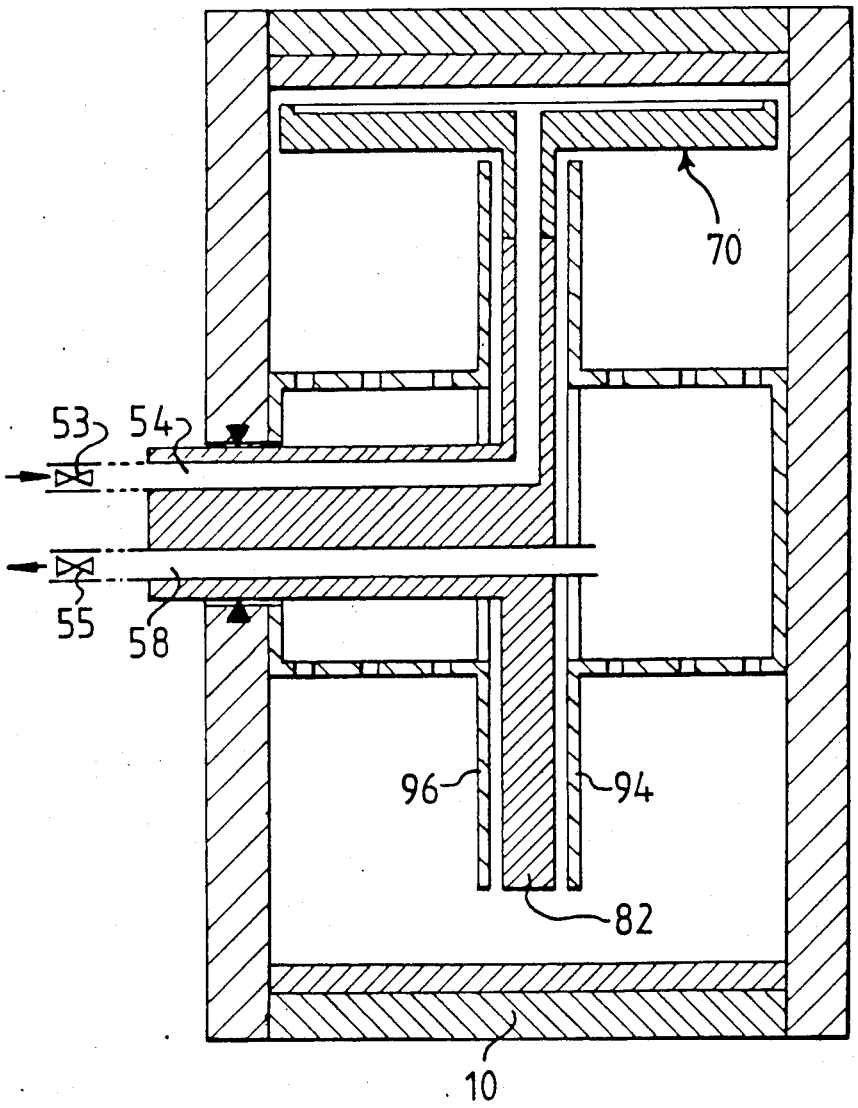
FIG. 6 shows a modification of the embodiment of FIG. 5.

FIG. 6 shows a modification of the embodiment of FIG. 5, wherein the probe supporting disc 82 is positioned at the axial centre of the housing 10. In this instance, two rotating guard discs 94 and 96 are provided, one adjacent each face of the supporting disc 82.

It is to be understood that although only one wing-like probe 70 is shown in each of FIGS. 5 and 6, two or more such probes 70 may be circularly spaced around the periphery of the disc support 82, with ports 54 interconnecting the different apertures 78 to the inlet.

Protrusions of varying cross sectional shape have been shown in the pumps illustrated in the drawings. Experimental evidence indicates that the cross sectional shape of the protrusions which cooperate with the aperture containing surface(s) of the probe(s) has a considerable effect on the pumping speed (i.e., throughput) and the ultimately achievable vacuum, when using any given pump.

Examples of two cross sectional shapes which have worked reasonably well are shown in FIGS. 2 and 4. In the first case the cross sectional shape can be likened to a quadrant of a circle and in the second case the shape is generally semi-circular.

As shown in FIG. 2 the curved face of each protrusion constitutes the trailing edge as viewed by the probe. Experiments have revealed that the opposite orientation of this quadrant-like cross sectional shape may produce better performance, i.e., with the curved faces now seen as the leading edges of the protrusions as viewed from the probe.

Other cross sectional shapes which have been employed are triangular section protrusions and good results were also obtained.

Experimental evidence to date suggests that further improvements might be obtained by using protrusions in the form of generally radially directed blades. The expression "generally radially directed" includes blades which extend from the part of the pump on which they are mounted both in a true radial direction and blades which are inclined to the true radial direction either in the direction of rotation or opposite thereto. The blades may be straight when viewed from one end, or may be curved convexly or concavely or in a complex manner.

Generally the protrusions will extend as shown in the example radially either inwardly from the housing or outwardly from a central hub (as in FIG. 1), but when the suction aperture(s) is/are located in a radially extending external probe surface, the protrusions need to extend in an axial sense, at least in part, so at to cooperate therewith.

The rotatable part of any of the pumps so far described may be driven by an electric motor or other drive unit. However, where the liquid is either magnetic, magnetisable or conductive and the housing is of a material which does not significant interfere with a magnetic flux field, the housing and other pump parts may remain stationary and the relative rotation may be effected by influencing the liquid with a rotating magnetic flux as described in relation to FIG. 4. Such a rotating magnetic field may be utilised alone or in conjunction with rotation by an electric motor or other drive unit.

When a pump such as described in FIGS. 3 to 5 is mounted directly on a motor, it will be appreciated that the housing can be directly attached to the motor shaft and the hub fixed to the motor frame. All that is required (see FIGS. 5 and 6) is an annular seal such as of rubber, synthetic rubber or PTFE between the housing and the hub. Bearings are not required.

In a multistage line of pumps, connected outlet to inlet in a series, the connections are preferably made near the centre line of the housings, thus enabling filling with working liquid from one end, provided that at least one probe in each pump stage is downwardly directed during such a filling operation to enable liquid passage from one housing to the next via each such probe.

Also, as is conventional in a single or multistage pump, an anti-suck back valve or reservoir may be fitted at the inlet when the pump is to be used in the suction mode.

Typical speeds of operation may be 750, 1500 or 3000 RPM in accordance with normal operating speeds of synchronous machines. In the case of FIG. 5 or FIG. 6 embodiment, for example, a pump operating at 3000 r.p.m would require a supporting disc diameter of the order of 12 cm.

I claim:

1. A pump comprising:

(1) a pump housing having a generally cylindrical interior and enclosing a quantity of working liquid, (2) at least one probe having at least one aperture on its external surface and positioned in the housing, (3) internal passage means in the probe for communicating said at least one aperture with a first external space, (4) means for causing the liquid to move in a circular path inside the housing and relative to the probe, the liquid passing over the external surface of the probe and past the aperture in the probe, and (5) outlet means for communicating between a second external space and a central region of the housing which in use is free of liquid, whereby fluid to be pumped is drawn through the probe to pass out of said aperture into the liquid, by virture of the suction effect of the liquid passing over the aperture, to move as fluid bubbles toward the central region of the housing as a result of centrifugal forces acting on the more dense liquid, the bubbles migrating through the circulating liquid into the central region to pass out of the housing through the outlet means.

2. A pump as claimed in claim 1, wherein the pump housing forms the stator of the pump and carries the probe, whilst the rotor is formed by the circulating liquid, and the means for causing the liquid to move in a circular path is an impeller constituting the inner part of the pump, mounted coaxially within the housing and having radially-extending blades which extend into the liquid flow path.

3. A pump as claimed in claim 1, wherein the pump housing rotates about a central hub, and the rotation of the housing produces the desired circular movement of the liquid, the probe being mounted on the central hub so that it projects radially from the hub into the liquid flow path.

4. A pump as claimed in claim 1, wherein the probe is in the form of a wing-shaped member extending parallel to the pump axis.

5. A pump as claimed in claim 4, wherein the wing has a ramp surface at the leading edge thereof preceding the aperture and said aperture is provided at the top of the ramp.

6. A pump as claimed in claim 1, wherein the pump has relatively rotating inner and outer parts of which the housing constitutes the outer part, one part carrying the probe and the other causing the liquid to move in said circular path.

7. A pump as claimed in claim 6, wherein the said other part carries angularly spaced protrusions.

8. A pump as claimed in claim 7, wherein said protrusions pass sufficiently close to the probe to cause short bursts of acceleration in the region of liquid local to the probe as said liquid is squeezed between the probe and the protrusion passing thereby, in order to enhance suction at the probe aperture.

9. A pump as claimed in claim 1, wherein the probe is supported by a stationary disc located within the pump housing and the latter constitutes the rotating part of the pump.

10. A pump as claimed in claim 9, having members each being on opposite sides of the supporting disc, which members have respective plate surfaces spaced from respective faces of the supporting disc to form narrow liquid receiving spaces.

11. A pump as claimed in claim 10 wherein one face of the supporting disc is spaced from one of said members which comprises an end face of the housing by a film of liquid and the other face of the disc is spaced by another film of liquid between said other disc face and a second one of said members comprising a guard disc mounted to rotate with the housing.

12. A pump as claimed in claim 11, wherein the mounting of the guard disc is apertured to provide for passage of fluid to the central region of the housing.

13. A pump comprising:

(1) a pump housing having a generally cylindrical interior and enclosing a quantity of liquid, (2) at least one probe having at least one aperture on its external surface and internal passage means for communicating said at least one aperture with a first external space, (3) means for driving the housing and thereby causing the liquid to move in a circular path inside the housing and relative to the probe, the liquid passing over the external surface of the probe and past the aperture in the probe, (4) outlet means for communicating between a second external space and a central region of the housing which in use is free of liquid, whereby fluid to be pumped is drawn through the probe to pass out of the aperture into the liquid, by virtue of the suction effect of liquid passing over the aperture, to move as fluid bubbles towards the central region of the housing as a result of centrifugal forces acting on the more dense liquid, the bubbles migrating through the circulating liquid into the central region to pass out of the housing through the outlet means, and wherein:

(5) said housing has internal protrusions which pass sufficiently close to the aperture probe to enhance the suction of fluid therefrom.

14. A pump as claimed in claim 13, wherein the probe is in the form of a wing apertured on its external surface at a region of low liquid pressure in use.

15. A pump as claimed in claim 13, including a central hub and a disc on said hub for supporting the probe.

16. A pump as claimed in claim 15, having members each arranged on either side of the supporting disc which members have respective plate surfaces narrowly spaced from respective faces of the supporting disc.

17. A pump as claimed in claim 16, wherein one face of the supporting disc is spaced from one of said members which comprises an end face of the housing by a film of liquid and the other face of the disc is spaced by another film of liquid between said other disc face and a second one of said members comprising a guard disc mounted to rotate within the housing.

18. A pump as claimed in claim 13, wherein the probe is in the form of a wing extending in the axial direction of the housing, and the protrusions and aperture in the probe are elongated in said axial direction.

19. A pump as claimed in claim 18, wherein the wing has a ramp surface at the leading edge of the wing preceding the aperture.

20. A pump as claimed in claim 19, wherein the aperture is disposed at the top of the ramp.

21. A pump as claimed in claim 19 wherein there is provided a ridge-like protrusion upstanding from the ramp surface and extending at least part-way thereacross to serve as a fluid flow disturbing means.

22. A method of pumping a fluid from one region to another by employing a suction effect produced when a liquid flows over a surface containing an orifice which communicates with the said one region, comprising the steps of:

(1) causing a liquid having a density greater than that of the fluid, to flow over an external surface of a member having at least one orifice in said external surface, to create a suction effect at the orifice by virtue of the movement of liquid over the orifice, to draw fluid from the said one region out of the orifice into the liquid moving past the orifice;

(2) constraining the liquid to follow a curved path so as to introduce centrifugal forces therein and thereby produce radial separation of the liquid and the less dense fluid entrained therein, and (3) conveying the displaced fluid to the said other region.

* * * * *